United States Patent [19]

Barnes et al.

[11] Patent Number: 4,478,896

[45] Date of Patent: Oct. 23, 1984

[54] APPARATUS FOR BLENDING WOOD STRANDS WITH A LIQUID RESIN

[75] Inventors: Derek Barnes, Vancouver; Jan A. H. Dessens, Hudson Bay; George N. Rosenberg, Vancouver, all of Canada

[73] Assignee: MacMillan, Bloedel Limited, Vancouver, Canada

[21] Appl. No.: 441,925

[22] Filed: Nov. 15, 1982

[51] Int. Cl.[3] ..... B05D 1/02; B05B 17/00

[52] U.S. Cl. ..... 427/421; 427/424; 427/212; 427/196; 118/303; 118/316

[58] Field of Search ..... 427/421, 424, 196, 212; 118/303, 316; 264/123

[56] References Cited

U.S. PATENT DOCUMENTS

| | | | |
|---|---|---|---|
| 2,744,045 | 5/1956 | Collins | 118/314 |
| 3,143,428 | 8/1964 | Reimers et al. | 118/303 |
| 3,916,825 | 11/1975 | Schnitzler et al. | 118/303 |
| 4,116,163 | 9/1978 | Torelli et al. | 118/303 |
| 4,320,715 | 3/1982 | Maloney et al. | 118/303 |
| 4,323,314 | 4/1982 | Kaiser-Wirz | 366/167 |

FOREIGN PATENT DOCUMENTS

| | | | |
|---|---|---|---|
| 2913081 | 11/1980 | Fed. Rep. of Germany | 118/303 |
| 2935478 | 3/1981 | Fed. Rep. of Germany | 118/314 |
| 275892 | 8/1980 | France | 366/167 |

*Primary Examiner*—John E. Kittle

*Assistant Examiner*—James J. Seidleck

*Attorney, Agent, or Firm*—Banner, Birch, McKie & Beckett

[57] ABSTRACT

An apparatus is disclosed for blending wood strands with a liquid resin. A process is also disclosed for continuously blending wood strands with a liquid resin. The apparatus overcomes some of the problems that exist with present day blenders because it avoids clogging spray nozzles and allows complete coating of the strands with a minimum amount of resin. The apparatus forms a substantially constant flow of wood strands into a first falling curtain of separated wood strands, the first curtain having a predetermined substantially constant width, a first liquid spray including at least one spray nozzle located on each side of the first falling curtain of separated wood strands away from the first falling curtain, adapted to spray liquid resin droplets for the width of the first curtain, but not substantially beyond; collector for collecting the first sprayed wood strands and forming them into a second falling curtain of separated wood strands, the second curtain having a predetermined width, and a second liquid spray including at least one spray nozzle located on each side of the second falling curtain of separated wood strands away from the second falling curtain, adapted to spray liquid resin droplets for the width of the second curtain but not substantially beyond.

8 Claims, 2 Drawing Figures

APPARATUS FOR BLENDING WOOD STRANDS WITH A LIQUID RESIN

The present invention relates to the production of the particleboard. More specifically the present invention provides an apparatus for coating wood strands with a liquid resin.

The term "wood strands" includes particles, flakes, wafers, chips used in the production of a particleboard such as waferboard. The wood strands are coated with an adhesive resin and then formed into a mat for compression and curing to produce a board.

The most common adhesive used in the preparation of waferboard is phenol formaldehyde. Most waferboard mills apply this adhesive in a powder resin form by mixing the resin with the wafers in a rotary drum blender. Phenol formaldehyde is also available in liquid form which is less expensive than the powder. Considerable savings may be achieved by waferboard manufacturers with liquid resin on an equivalent resin solids basis while still ensuring that the adhesive coating is applied evenly on wafer surfaces.

The main problem with using liquid resin today is that when low levels of application, i.e. 2% to 4%, are attempted for economic reasons, the drum type blender does not provide even distribution of the resin on the wafer surfaces. Thus, some surfaces or portions of some surfaces are left uncoated. The result of this uneven resin distribution is that the resulting particleboard does not achieve its maximum strength potential. Attempts have been made to overcome this uneven distribution of the liquid resin by increasing the number of spray nozzles in a blender, or by using a rotating disc to apply the resin instead of spray nozzles. However, none of these approaches have been effective to date in attaining even distribution of the resin on the wafer at low enough resin levels to be cost-effective. A disadvantage of the use of multiple spray nozzles is that invariably one or more become blocked and are often inaccessible for maintenance purposes.

The drum type blenders are not suited for continuous operation with liquid resin because the flights that create the curtain of wood strands within the drum tend to become clogged with a buildup of wafers and resin. If these flights in the drum are not able to perform their function, then the curtain of wafers becomes too thick which results in some of the wafers being screened from the resin spray. Furthermore in drum type blenders, the spray nozzles are invariably placed in the curtain of wood strands which contributes to the blocking of the nozzles.

The present invention overcomes the problems of liquid resin blending described above by providing a multiple pass blender including a series of falling curtains of separated wood strands and providing spray nozzles away from the falling curtains, to spray liquid resin droplets from both sides of the curtains. The sprays extend through the curtain but not far beyond it and mixing of the wafers between each stage may be provided to assure random distribution of wafer surfaces exposed to the liquid resin spray. This multiple pass operation with remixing between passes, ensures the coating of sufficient wood strands to give good particleboard strength properties with liquid resin.

The horizontal cross-section of the falling curtain of strands has "length" which is the largest distance along the boundaries of the curtain, and "width" which is the distance between the two boundaries of the curtain.

The multiple pass operation may be used with the addition of a wax coating sprayed onto the wood strands. A combination of liquid and powder resin may be applied to the wood strands, with a mixing of the strands between each falling curtain. Furthermore, the multiple pass operation permits two or more types of resin, chemical additives such as wax, fire retardants, preservatives and the like, to be sprayed onto the wood strands.

The present invention provides an apparatus for continuously blending wood strands with a liquid resin comprising means for forming a substantially constant flow of wood strands into a first falling curtain of separated wood strands, the first curtain having a predetermined substantially constant width; first liquid spraying means including at least one spray nozzle located on each side of the first falling curtain of separated wood strands away from the first falling curtain, adapted to spray liquid resin droplets for the width of the first curtain, but not substantially beyond; collector means for collecting the first sprayed wood stands and means for forming the first sprayed wood strands into a second falling curtain of separated wood strands, the second curtain having a predetermined width; and second liquid spraying means including at least one spray nozzle located on each side of the second falling curtain of separated wood strands away from the second falling curtain, adapted to spray liquid resin droplets for the width of the second curtain but not substantially beyond.

In embodiments of this invention additional means of forming the wood strands into further falling curtains are provided with additional liquid spraying means to spray either side of the further curtains for the width of curtain but not substantially beyond. In another embodiment the spray nozzle on one side of the curtain may be placed at a different elevation to the spray nozzle on the other side of the curtain. In still a further embodiment the initially sprayed wood strands may be mixed together before being formed into the next falling curtain.

The present invention also provides a process for continuously blending wood strands with a liquid resin, comprising the steps of advancing a substantially constant flow of wood strands to form a first falling curtain of separated wood strands, the first curtain having a predetermined substantially constant width; spraying liquid resin droplets on each side of the first curtain, the spraying extending from both sides of the width of the first curtain, but not substantially beyond, collecting the first sprayed wood strands and advancing the first sprayed wood strands to form a second falling curtain of separated wood strands, the second curtain having a predetermined substantially constant width; and spraying liquid resin droplets on each side of the second curtain, the spraying extending from both sides of the width of the second curtain, but not substantially beyond.

In a further embodiment of this process at least one further falling curtain of separated wood strands is provided, and liquid resin droplets are sprayed on both sides of the further curtain for the width of the curtain but not substantially beyond. In another embodiment the wood strands are mixed between each spraying step. Phenol formaldehyde is disclosed as a preferred liquid resin and the number of spraying steps is preferably sufficient to minimize the probability that two uncoated surfaces are adjacent to each other in the particleboard and thus reduce the internal bond strength.

In drawings which illustrate the embodiments of the invention

Figures 1, 2:
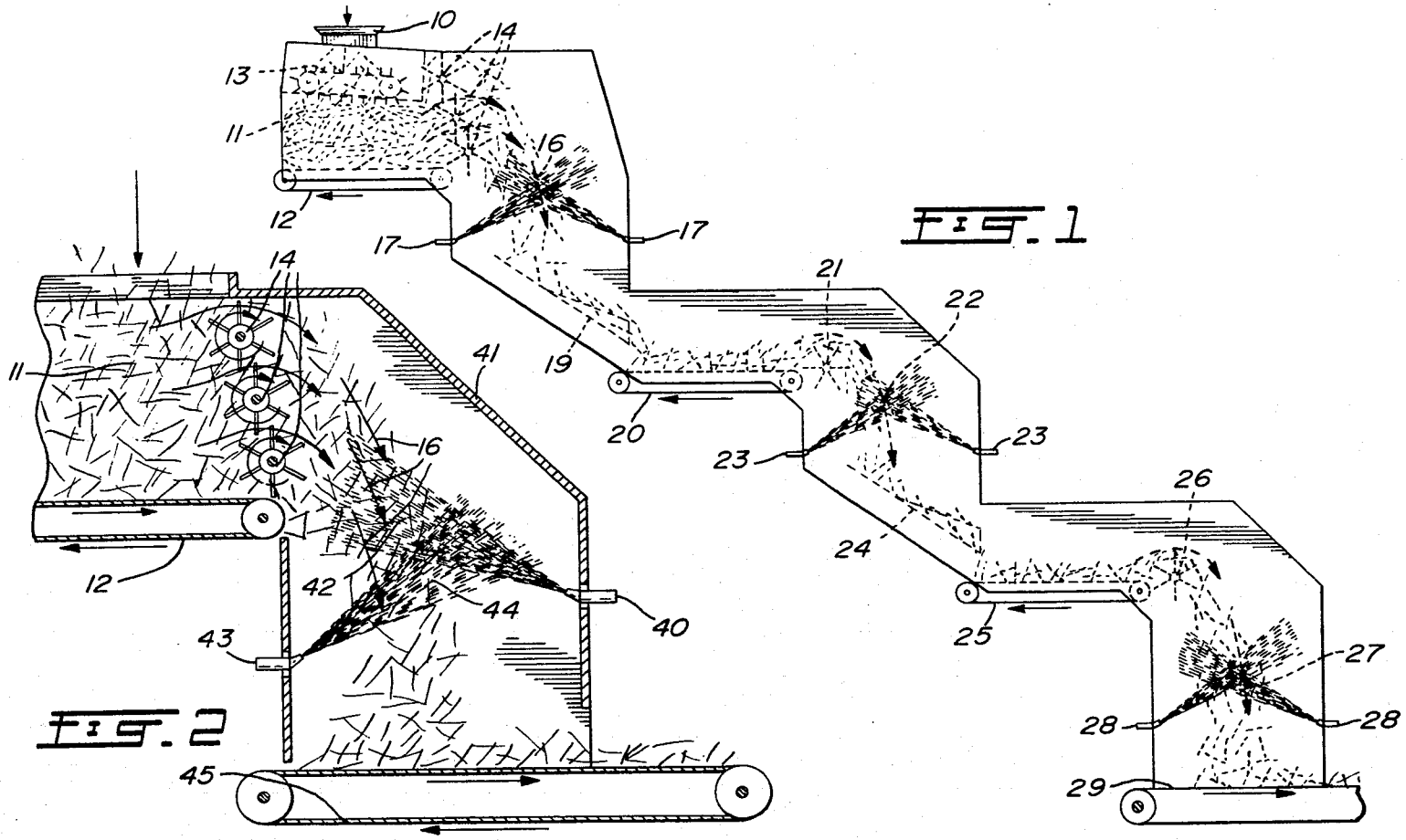
FIG. 1 is an elevational view of one embodiment of the multiple pass bender according to the present invention.
FIG. 2 is a partial elevational view showing one embodiment of an interior of a curtain forming and spraying system for use in a multiple pass blender.

Referring now to FIG. 1, a three pass blender is illustrated. Wood strands are fed through an entrance 10 to form a pile 11 of strands resting on an apron belt conveyor 12. The level of the pile 11 is controlled by a rake back conveyor 13. A number of spike rolls 14 are arranged in a substantially vertical plane with slight slope back towards the rake back conveyor 13 to pick individual strands from the pile 11 and deposit them into a first falling curtain 16 of separated wood strands. The rotational speed of the spike rolls 14 and the speed of the apron belt conveyor 12 may be individually varied to control the flow of strands to the first curtain 16. The rotational speed of spike rolls 14 also controls the width of the curtain 16 of strands which fall in front of the spray nozzles 17, at least one on each side of the curtain 16. Whereas two nozzles are illustrated one on each side it will be understood that there may be three or four nozzles along the length of the curtain depending on the overall length of the curtain of strands. A common length of curtain 16 is four feet, and it is found that two nozzles 17 on each side are satisfactory for this distance. The nozzles 17 produce a spray of liquid resin particles which are directed through to the other side of the curtain 16 but not far beyond the curtain and certainly not as far as the housing. Thus a cloud of liquid resin droplets is produced through which the curtain 16 of wood strands fall. There is little or no wastage of liquid resin as it all settles on the falling strands.

As illustrated in dotted lines in FIG. 1, a baffle or deflector 19 is positioned beneath the first curtain 16 so that the wood strands which have been sprayed once with the liquid resin are mixed. The mixing action deflects the outside wood strands in towards the center, and deflects the strands in the center towards the outside. The first sprayed strands are then deposited on a belt conveyor 20 which delivers them to a spike roll 21 for picking individual strands off the belt conveyor 20 and forms them into a second curtain 22 of separated wood strands. The width of the second curtain 22 may be controlled by the rotational speed of the spike roll 21. Spray nozzles 23 on each side of the second curtain 22 spray liquid resin droplets onto the second curtain and through the curtain but not far beyond and certainly not so far as the housing. The second curtain 22 falls through a cloud of liquid resin droplets as in the first spray curtain 16 and then onto a second baffle or deflector 24 to mix the wood strands before depositing them onto another conveyor belt 25. This conveyor belt 25 is similar to the first conveyor belt 20 and has a spike roll 26 positioned at the end to pick up the strands off the belt 25 and form a third curtain 27 of separated wood strands. The width of this third curtain is controlled by the speed of the spike roll 26. The third curtain 27 falls past two spray nozzles 28 which provide a cloud of resin droplets as in the first and second spray curtains. The wood strands are deposited onto an output conveyor 29 which conveys them to the next step in the preparation of a particleboard.

Another embodiment of a curtain spray system is illustrated in FIG. 2 wherein an apron feed belt 12 feeds a pile of wood strands 11 towards a number of spike rolls 14 which pick out individual strands to form a first curtain 16 of separated wood strands to drop past a first spray nozzle 40 mounted on the far side of housing 41 which sprays a cone shaped cloud 42 of liquid resin droplets and then past a second spray nozzle 43 located below the first spray nozzle 40 and on the near side of the housing 41 which sprays a second cone shaped cloud 44. Both cone shaped clouds of liquid resin droplets extend almost as far as the opposite wall of housing 41 but do not reach the housing wall thus the liquid resin droplets are sprayed onto the wood strands passing in the curtain 16 or fall with the wood strands. Little or no resin is deposited on the sides of the housing 41. The wood strands in the curtain drop onto the conveyor 45 which passes to a second spray curtain or in the case of the last spray curtain to a further processing step. A baffle or deflector is not illustrated in this embodiment, but may be included as shown in FIG. 1.

By using a multiple pass blending system the exposure time of the strands to the liquid resin is increased and thus the resin distribution on the wood strands is improved. Whereas a multiple pass blending apparatus is disclosed in the drawing, in certain instances it is feasible to recirculate the strands more than once through a single spray curtain system. It is preferred to mix the strands between the spraying stages to ensure that the strands do not fall in the same pattern from one pass through the spray curtain to the next.

The liquid resin may be applied using an air spray system, an airless system, or a rotating disc system; it being important that the resin does not spray onto the far wall of the housing surrounding the curtain. The control of the resin spray is at least partially achieved by controlling the density of the curtain. The wafer flow rate which is controlled by the speed of the apron belt conveyor 12, and the width of the curtain which is controlled by the speed of the spike rolls 14, prevent the resin spraying on the far wall of the housing.

To test the concept of the multiple pass blender a factorial experiment was designed based on the number of passes made by the wood strands through the blender. A preferred coverage of the surface area of the wood strands results when the probability of two uncoated surfaces being adjacent to each other in the particleboard was minimized. Practical evidence that this minimum had been achieved was demonstrated when three or four passes produced a high internal bond. Further passes do not result in significant increases in this strength parameter.

For the preparation of waferboard, a 22 inch wide experimental blender was constructed to produce a wood wafer flow rate of 90 lb/min. An airless spray system was mounted on either side of a wafer collection box. Samples of wood wafers were passed through the liquid resin blender and waferboards were produced for conditions with one, two, three and four passes. The adhesive resin application of 2.5% at 45% resin solids was applied. For the four pass run, the resin was diluted to 35% resin solids in order to have a sufficient quantity of liquid to spray onto the wood strands. Boards were produced for each condition and the internal bond was determined for each of the waferboards. The results of two separate trials in Table 1 show the effect of the number of passes on the internal bond with a wafer flow rate of 90 lb/min.

TABLE 1

| No. of Passes | Internal Bond, psi* Trial 1 | Trial 2 |
|---|---|---|
| 1 | 31.5 | 36.8 |
| 2 | 49.6 | 59.8 |
| | 51.2 | 58.1 |
| 3 | 56.8 | 59.8 |
| 4 | 66.5 | 63.5 |
| | 57.3 | |
| | 60.1 | |

*Adjusted to an average specific gravity of 0.700.

Variation of the apron belt speed affects the wafer flow rate and controls the penetration of resin into the curtain. For example, if the wafer flow rate is too heavy causing a dense curtain, strands are screened from the resin spray. If the curtain is too light, resin passes between the strands hitting the wall of the collection box.

A series of trials at different wafer flow rates demonstrated the effect of curtain density on blender efficiency. At the wafer flow rate of 90 lb/min, the resin was used as supplied at 45% resin solids and applied a resin content of 2.5%, while at lower wafer rates the resin was first diluted to 35% resin solids before being used. The results in Table 2 show the effect of water flow rate on the internal bond.

TABLE 2

| Wafer Flow Rate lb/min | No. of Passes | Internal Bond psi* |
|---|---|---|
| 90 | 2 | 58.9 |
| | | 57.2 |
| 70 | 2 | 61.2 |
| 45 | 2 | 53.9 |
| | | 53.1 |
| 90 | 3 | 61.3 |
| | | 54.4 |
| | | 55.2 |
| | | 53.9 |
| 70 | 3 | 65.3 |
| | | 64.6 |
| | | 65.5 |
| | | 71.7 |
| 45 | 3 | 72.5 |

*Adjusted to an average specific gravity of 0.693.

The multiple pass blender may be used with a mixture of liquid resin and powder resin. Furthermore wax or other additives may be sprayed onto the curtain of falling strands, either in a separate spray curtain or at one or more of the spray curtains where liquid resin is applied. Different types of liquid resin may be applied in multiple stages. A two component liquid resin, for example, can be applied at two separate stages.

Various changes may be made to the scope of the present invention which is limited only by the following claims.

The embodiments of the invention in which an inclusive property or privilege is claimed are defined as follows:

1. Apparatus for continuously blending wood strands with a liquid resin comprising:

means for forming a substantially constant flow of wood strands into a first falling curtain of separated wood strands, the first curtain having a predetermined substantially constant width;

first liquid spraying means including at least one spray nozzle located on each side of the first falling curtain of separated wood strands away from the first falling curtain, adapted to spray liquid resin droplets for the width of the first curtain, but not substantially beyond;

collector means for collecting the first sprayed wood strands and means for forming the first sprayed wood strands into a second falling curtain of separated wood strands, the second curtain having a predetermined width; and second liquid spraying means including at least one spray nozzle located on each side of the second falling curtain of separated wood strands away from the second falling curtain, adapted to spray liquid resin droplets for the width of the second curtain but not substantially beyond.

2. The apparatus according to claim 1 including at least one additional means for forming the wood strands into a further falling curtain of separated wood strands after the second liquid spraying means, and a further liquid spraying means for spraying liquid resin droplets for the width of the further curtain but not substantially beyond.

3. The apparatus according to claim 1 wherein at least one spray nozzle of the liquid spraying means on one side of the falling curtain is located at a higher elevation than at least one spray nozzle on the other side of the falling curtain.

4. The apparatus according to claim 1 including a deflector located after the first liquid spraying means to mix the first sprayed wood strands before being formed into a second falling curtain.

5. A process for continuously blending wood strands with a liquid resin, comprising the steps of:

advancing a substantially constant flow of wood strands to form a first falling curtain of separated wood strands, the first curtain having a predetermined substantially constant width;

spraying liquid resin droplets on each side of the first curtain, the spraying extending from both sides of the width of the first curtain, but not substantially beyond;

collecting the first sprayed wood strands and advancing the first sprayed wood strands to form a second falling curtain of separated wood strands, the second curtain having a predetermined substantially constant width; and spraying liquid resin droplets on each side of the second curtain, the spraying extending from both sides of the width of the second curtain, but not substantially beyond.

6. The process according to claim 5 including forming at least one further falling curtain of separated wood strands and spraying liquid resin droplets from both sides of the further curtain for the width of the further curtain, but not substantially beyond.

7. The process according to claim 5 including spraying liquid resin droplets at different elevations on both sides of the falling curtain.

8. The process according to claim 5 including mixing the wood strands between the spraying steps.

* * * * *